US005421627A

United States Patent [19]

Yane

[11] Patent Number: 5,421,627

[45] Date of Patent: Jun. 6, 1995

[54] HIGH PERFORMANCE DOOR LATCH MECHANISM FOR SLIDING DOORS

[75] Inventor: Barry Yane, Hampstead, Canada

[73] Assignee: Standard Building Components, Lachine, Canada

[21] Appl. No.: 61,726

[22] Filed: Oct. 20, 1993

[30] Foreign Application Priority Data

Apr. 29, 1993 [CA] Canada ..... 2095163

[51] Int. Cl.[6] ..... E05B 1/04

[52] U.S. Cl. ..... 292/162; 292/DIG. 46; 292/101

[58] Field of Search ..... 292/DIG. 46, 162, 161, 292/120, 145, 146, 101, 106

[56] References Cited

U.S. PATENT DOCUMENTS

| | | | |
|---|---|---|---|
| 1,438,547 | 12/1922 | O'Connor | 292/161 |
| 1,979,560 | 11/1934 | Levine | 292/161 |
| 3,006,270 | 10/1961 | Graham | 292/162 |
| 3,173,716 | 3/1965 | Silvers | 292/DIG. 46 |
| 3,213,652 | 10/1965 | Tucker | 292/145 |
| 4,401,247 | 8/1983 | Zoor | 70/DIG. 57 |
| 4,480,862 | 11/1984 | Fleming | 292/162 |
| 4,607,510 | 8/1986 | Shanaan et al. | 292/DIG. 46 |
| 5,163,308 | 11/1992 | Lillo | 70/56 |

*Primary Examiner*—Peter M. Cuomo
*Assistant Examiner*—Darnell M. Boucher

[57] ABSTRACT

A latch mechanism for securement to an edge portion of a closure element, and more particularly, but not exclusively, a sliding door. The door latch mechanism has a housing with a slide member having keeper engaging hook members to engage a keeper secured to a door jamb for locking and unlocking the door within a door frame. The slide member is guided along a straight axis and is connected to a finger engaging knob to displace it along that axis to lock and unlock the mechanism with the keeper. The slide member has one or two elongated through bores extending co-extensively with the straight axis and a load transfer pin-like member extends through the bores and connected on opposed sides to transfer lateral loads applied to the slide member to the door latch mechanism housing and door stile.

11 Claims, 3 Drawing Sheets

HIGH PERFORMANCE DOOR LATCH MECHANISM FOR SLIDING DOORS

BACKGROUND OF INVENTION

1. Field of the Invention

The present invention relates to a latch mechanism for securement to the style of a closure element, and particularly, but not exclusively, to a sliding door and capable of achieving high performance resistance against forced entry.

2. Description of Prior Art

The door latch mechanism of the present invention is particularly useful for securement to the style, or for incorporation within the style, of a sliding door, such as a patio door. Various door latch mechanisms are known, such as disclosed in U.S. Pat. No. 4,607,510, for securement to sliding doors, and these are essentially comprised of a slide plate guidingly located in a housing and provided with one or more hook fingers for engagement within a keeper housing. However, some of these door latch mechanisms do not provide adequate resistance to force entry and their resistance performance level is usually within the F1 or F2 range of forced entry tests, as well known in the art. Some of the problems encountered during forced entry include: disconnection of the locking fingers from the keeper member by lifting the door panel or jumping the panel from its support track;, breakage or disconnection of the keeper member by applying a lateral sliding force to the sliding door; breakage or disconnection of the latch plate or keeper; and material failure under load due to poor design and inadequate material strength.

SUMMARY OF INVENTION

It is a feature of the present invention to provide a latch mechanism capable of achieving the highest performance test level in North America for resistance to forced entry and which substantially overcomes the above-mentioned disadvantages of the prior art.

A further feature of the present invention is to provide a latch mechanism capable of achieving the highest performance test level in North America for resistance to forced entry; and which will attain the performance level 40 and overcome the above-mentioned disadvantages of the prior art.

Another feature of the present invention is to provide a latch mechanism for securement to the vertical stile of a sliding door and wherein the slide plate is provided with one or more slots through which load transfer bolts are anchored into the main body of the handle to transfer lateral loads from the slide plate into the lock housing and vertical stile of the sliding door.

Another feature of the present invention is to provide a latch mechanism in combination with a keeper member and wherein the keeper member is constructed of steel and has an improved structural design.

According to the above features, from a broad aspect, the present invention provides a latch mechanism for securement to an edge portion of a closure member. The latch mechanism comprises a housing having a slide member with one or more keeper engaging elements to engage a keeper member secured to a jamb for locking and unlocking the closure member within a frame. Guide means is provided in the housing for guiding the slide member along a straight axis. Finger engaging means is connected to the slide member and accessible for displacing the slide member along the said axis to move the keeper engaging means to a locking or unlocking position. The slide member has an elongated through bore extending co-extensively with the straight axis. A load transfer member extends through the bore and connected on opposed sides of the slide member to transfer lateral loads applied to the slide member.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
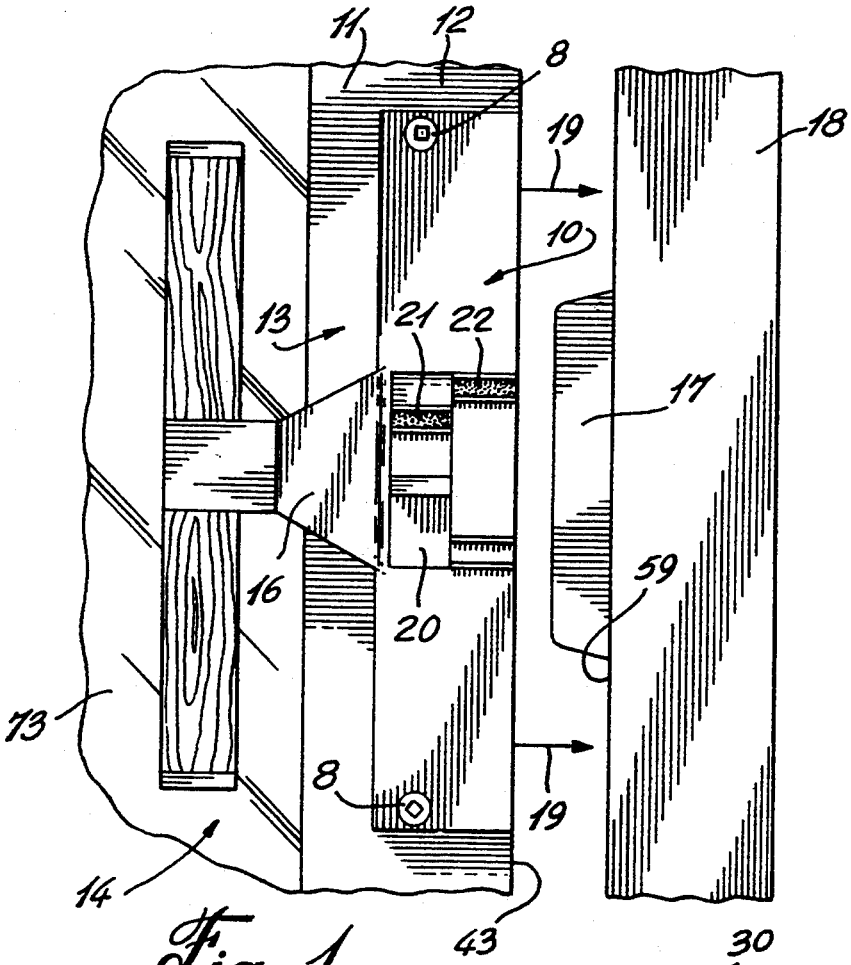
FIG. 1 is a fragmented side view showing the door latch mechanism of the present invention as secured to the inner surface of a vertical door stile of a sliding door and a keeper member secured to the door jamb and cooperating with the latch mechanism.

Referring now to the drawings, and more particularly to FIGS. 1 to 4, there is shown an application of the latch mechanism for securement to a sliding door. A door latch housing 10 is secured to the outer surface 11 of the inner side wall 12 of the vertical stile 13 of the sliding door 14 by a pair of bolts 8 The housing is a metal casted or plastic moulded housing and has a handle member 16 formed integral therewith for moving the sliding door to a closed and open position.

Figure 4:
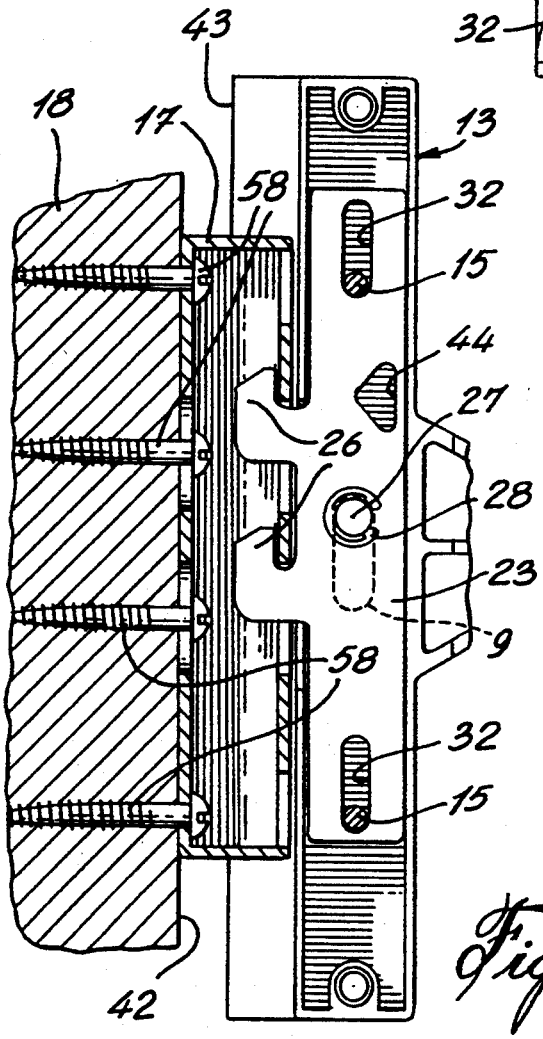
FIG. 4 is a fragmented rear view of the door latch housing showing the slide plate engaged with the keeper member which is secured to the door jamb.

A keeper member 17 is secured to the door jamb 18 and in alignment with the door latch housing 11. When the sliding door is moved in the direction of arrows 19 to a closed position, the keeper member 17 enters the door latch housing 10 for locking engagement therewith, as shown in FIG. 4. The locking engagement is effectuated by a finger engageable slide member 20 which is provided with a marker indicia 21 to indicate if the latch mechanism is in a locked or unlocked position. When the finger engageable slide member 20 is moved upwardly, the indicia 21 becomes aligned with a marker 22 indicating a lock condition.

Figure 2:
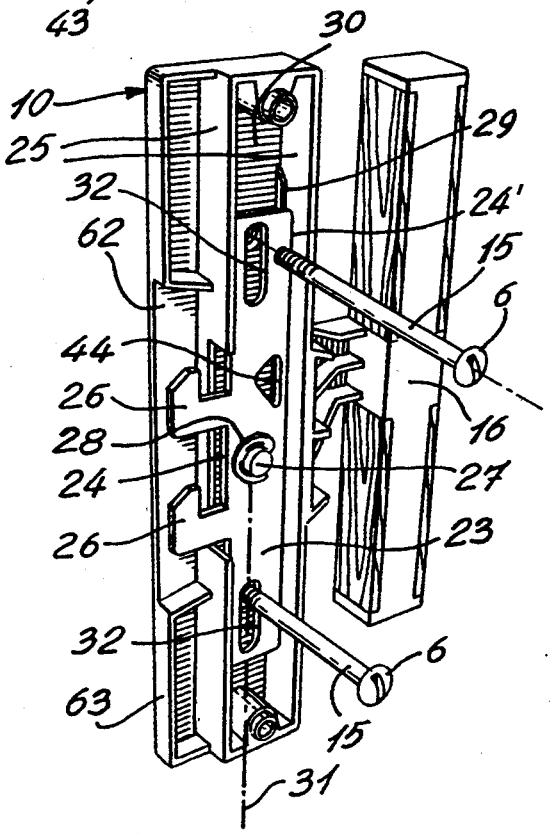
FIG. 2 is a rear perspective view of the door latch housing illustrating the construction and connection of the slide plate within the latch housing.
Figure 3:
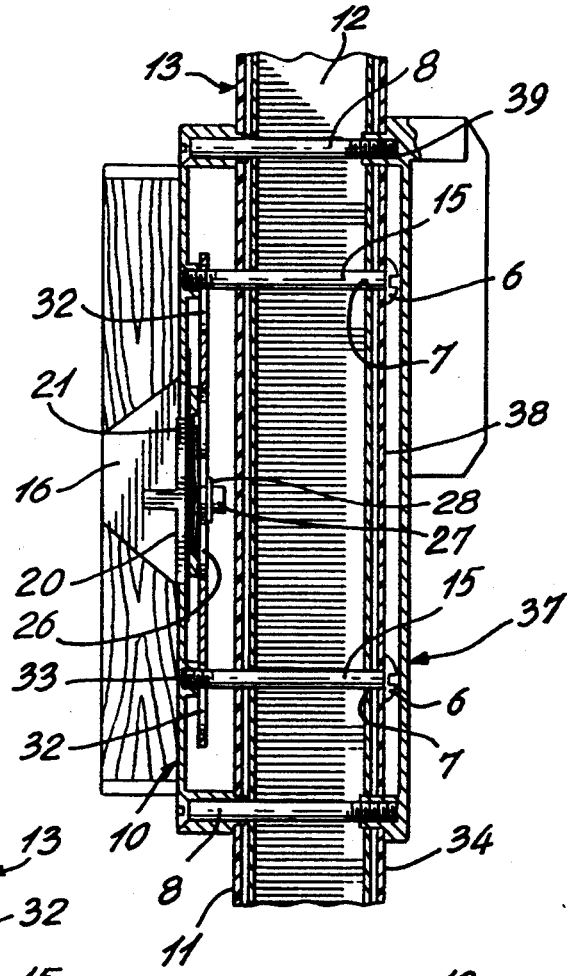
FIG. 3 is a side section view through a sliding door style and latch housing showing the connection of the door latch housing to the stile and the position of the load transfer bolts extending thereacross.

Referring now more specifically to FIGS. 2 to 4, there will be described the detailed construction of the door latch mechanism of the present invention. As shown in FIG. 2, the latch mechanism housing 10 houses a slide member formed as an elongated flat metal slide plate 23 having opposed parallel elongated side edges 24 and 24' which are disposed in close sliding fit between guide members, herein opposed side walls 25 of the door latch housing 10. The slide plate 23 has one or more keeper engaging elements, herein constituted by hook fingers 26, extending from the outer side edge 24 thereof and formed integral with the metal plate.

The finger engageable slide member 20, as shown in FIG. 1, is slidingly secured over the outer surface of the lock housing 10 and is provided with a connecting bolt 27 secured thereto and extending through a slot 9 (see FIG. 3) formed in the inner side wall 12 of the vertical stile 13 and secured to the slide plate 23 by a lock washer 28. The bolt 27 and the washer 28 retains the slide plate against support ribs 29 extending above the bottom wall 30 of the housing 10. The finger engageable member 20 displaces the slide plate 23 along a straight axis, herein the longitudinal axis 31, of the lock housing 10. A leaf spring maintains the slide plate 23 in the desired position, as determined by the position of the member 20.

As is better illustrated in FIG. 2, the slide plate 23 is provided with elongated through slots 32 adjacent opposed ends thereof and extending coextensively with the longitudinal axis 31. Load transfer bolts 15 extend through each of the slots 32 and transfer lateral loads applied to the slide plate 23. These bolts 15 are secured from the outer side wall 38 of the stile 13 through bores 7 provided in the style side walls 12 and 38. The head 6 of each bolt is concealed behind the handle plate 37 secured to the side wall 38. The threaded end 6 of the bolts are received in a threaded boss 35 provided in the back wall of the lock housing 10 and are thus also concealed. The bolts 8 also secure the handle plate 37 firmly over the outer surface 38 of the outer side wall 34 and the location of the threaded ends of the bolts 8 is also concealed by the plate 37. There are no fasteners visible on the outside wall 39 of the outer handle plate 37.

The bolts 15, as herein shown, constitute load transfer members, as previously mentioned, whereby to transfer lateral loads applied to the slide plate, in the direction of arrow 41, when a force is exerted between the inner edge 42 of the door jamb 18 and the inner edge 43 of the vertical stile 13 of the sliding door frame. As herein shown, these lateral loads applied to the slide plate 23 are transferred to the load transfer bolts 15 and their connecting points with the lock housing 10, and the door stile inner and outer side walls 12 and 34, respectively. Accordingly, the door latch can achieve very high lateral loads to resist forced entry by a separating force trying to pry open the door style by separating the style from the door jamb. The sliding plate is also of sufficient thickness and strength such that the hook fingers 26 as well as the plate can withstand these high loads.

The slide member is also provided with a locking slot 44 to receive a lock pin (not shown) of a key lock (not shown) and as is well known in the art. Although the load transfer members are herein shown as cylindrical bolt fasteners 15, these fasteners can have any desirable cross-sectional shape where they extend through the through slots 32 and side walls of the vertical style and could be of rectangular shape, provided they abut with at least the side edge 32' of the through bore or through slots 32 where the lateral loading force is applied.

Figure 5:
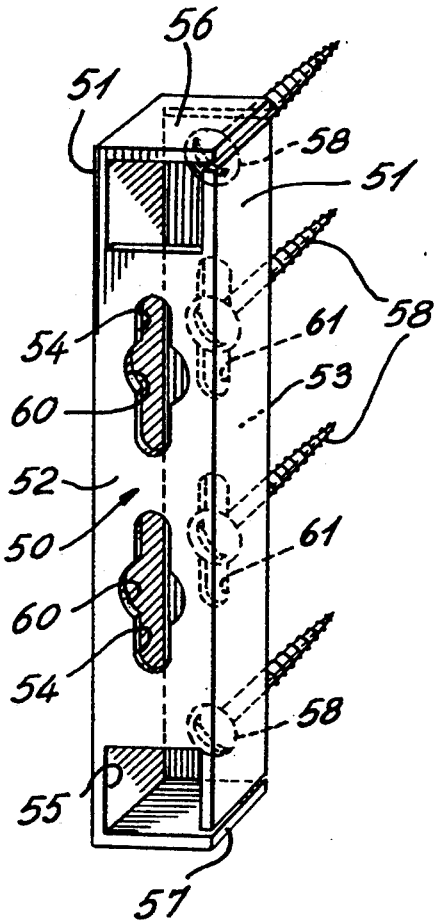
FIG. 5 is a perspective view illustrating the construction of the keeper member.

Referring now more specifically to FIGS. 4 and 5, there will be described the construction of the keeper member 17. The keeper member of this invention is herein formed from a single stamping from a stainless steel plate and shaped to define the hollow housing 50. The housing 50 has a pair of opposed side structural walls 51 and an integrally formed intermediate front wall 52 and a connecting rear wall 53. A pair of engageable slots 54 are formed in the front wall 52 and spaced apart a predetermined distance whereby to receive therein the hook fingers 26 of the latch slide plate 23, as shown in FIG. 4. A pair of opposed fastener receiving openings 55 are provided adjacent the top and bottom walls 56 and 57 respectively to provide the passage of fasteners 58 to secure the back wall 53 against a side edge 59 (see FIG. 1) of the door jamb 18. The slot openings or engaging slots 54 are also provided with enlargements 60 in opposed side edges thereof for the passage of the fasteners 58. As is also shown, two of the fastener receiving openings 61, in the rear connecting wall 53, are slot openings whereby to provide for vertical adjustment of the keeper member for precise alignment with the keeper receiving opening 62 (see FIG. 2) disposed centrally in the outer side edge 63 of the latch mechanism housing 10. After the keeper is aligned, the end fasteners 58 are screwed in.

The front wall 52 is reinforced by the structural side walls 51 so as to provide structural resistance against lateral pulling forces exerted by the hook fingers 26 when the sliding door is subjected to lateral loads whereby to resist entry by lateral forces. The four fasteners 58 are also of a selected length to resist the keeper from being torn away from the door jamb 18 under maximum loading forces, as specified. It has been found from loading tests that when the latch and keeper of the present invention is under heavy loads, in the level 40 test, the resistance to the loads was achieved by the combination of the keeper 50 and its retention 58, the slide plate 23, the flexibility of the housing 10 which was constructed of a synthetic material, the bolts 15 and the side walls 12 and 34 of the stile. It is also pointed out that the keeper 50 nests within the housing 10, as shown in FIG. 4, and thereby providing resistance against vertical forced entry.

Figure 6:
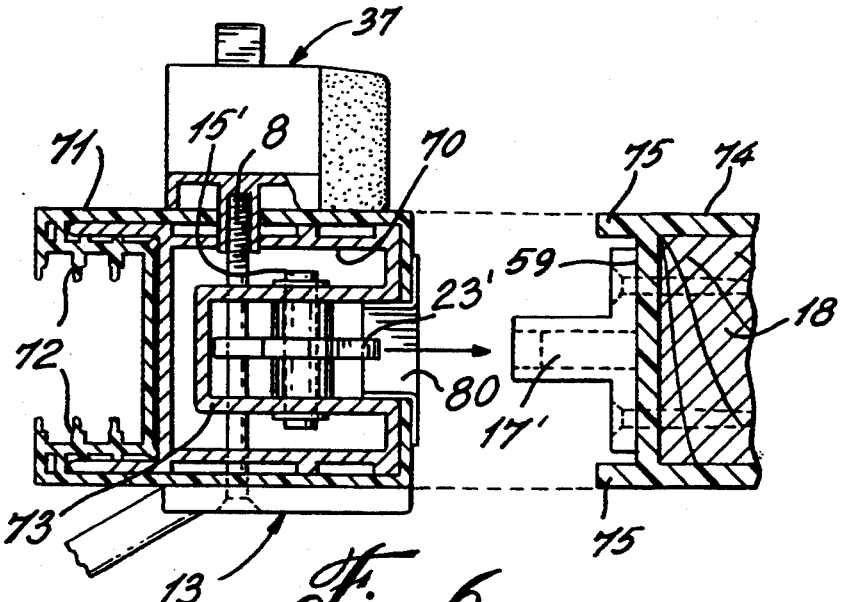
FIG. 6 is a cross-section view showing a modification of the door latch mechanism of the present invention wherein the latch mechanism is incorporated in the outer edge wall of a sliding door vertical style and the keeper member is secured in the side edge of a door jamb.

Referring now to FIG. 6, there is shown a further modification of the present invention wherein the door latch mechanism is shown incorporated within a housing 80 secured in a cavity provided in the side wall 43 of the vertical stile 13. As shown, the vertical stile is formed of an aluminum extrusion 70 or any structural materials capable of taking the required loads and is covered with a vinyl outer extrusion 71 and defines a door pane connecting cavity 72 to receive the glass pane 73 (see FIG. 1) therein, and as is well known in the art. The latch mechanism, as herein shown, is disposed within a housing 80 which is connected within the inner edge 43 of the aluminum extrusion 70 and provides for the guidance of the slide plate 23' along a vertical axis, as previously described. The connecting load transfer bolts 15' are secured in a similar manner but also extend through the inner transverse walls 73 of the housing 80. The keeper 17' is herein shown as mounted on the inner side edge 59 of the door jamb 18 and in alignment with the slide plate 23. An aluminum extrusion 74 forms an integral part of the door jamb and is provided with flanges 75 for receiving an edge portion of the sliding door stile 13 whereby to conceal the gap between the door stile and door jamb when the door is in a closed position.

Figure 7A:
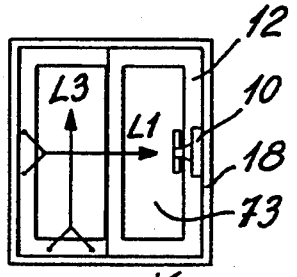
FIGS. 7A and 7B are schematic illustrations of a sliding door assembly as seen in plan view and in side cross-section, illustrating the load tests performed to determine the performance level of the door latch mechanism against forced entry.
Figure 7B:
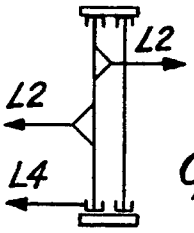

Referring now to FIGS. 7A and 7B, there is illustrated schematically the various loading tests performed for testing the load capacity of sliding door panels to determine their performance level against forced entry. Various tests are effected by hand tool, manipulation and by disassembling all screws, glazing retainers, or other fasteners which can be removed from the exterior of the sliding door and within certain time constraints. Static loads are applied to the door using various gain entry tools, such as knives, steel wire, steel bars, etc. whereby to apply forces in the directions indicated by arrows L1 to L4. Arrow L1 herein illustrates lateral loads imparted to the door frame to break or disconnect the latch mechanism and keeper, L2 illustrates transverse loads effected in either direction, L3 indicates lifting loads and L4 indicates forces against the bottom rail of the door to try and jump the sliding door panel off its sliding track.

As previously described, sliding or gliding doors (otherwise known as patio doors), are provided with latch assemblies which usually fall within the F1 and F2 performance levels. Such performance levels are illustrated in Table 1 hereinbelow. With the door latch of the present invention, the performance level 40 has been achieved and, in fact, tests have indicated that the door latch of the present invention exceeds the level 40 loading criteria. It is also pointed out that to each of the values listed in the Table and having an asterisk (*), the weight of the panel should be added. The designation N indicates Neutons.

TABLE 1

| IDENTIFICATION | | PERFORMANCE LEVEL | | | |
|---|---|---|---|---|---|
| SYMBOLS | UNITS | CAN F1 | F2 | 30 | 40 |
| TIME (min) | SI-(IMP) | USA 10 | 20 | 30 | 40 |
| T1 | min | 5 | 5 | 10 | 10 |
| T2 | min | 5 | 5 | 10 | 10 |
| L1 | N | 1334 | 2224 | 3559 | 4393 |
| | (1b) | (300) | (500) | (800) | (1100) |
| L2 | N | 778 | 1112 | 1779 | 2447 |
| | (1b) | (175) | (250) | (400) | (550) |
| L3 | N | 445* | 667* | 1334* | 2002* |
| | (1b) | (100)* | (150)* | (300)* | (450) |
| L4 | N | 133* | 222* | 445* | 667* |
| | (1b) | (30)* | (50)* | (100)* | (150)* |

It is within the ambit of the present invention to cover any obvious modifications of a preferred embodiment described herein, provided such modifications fall within the scope of the appended claims. For example, the latch mechanism of the present invention may be adapted to windows (sliding, casement, awning, etc.) as well as doors, which may be sliding or hinged. Materials may also be substituted where feasible.

I claim:

1. In combination a latch mechanism adapted for securement to an edge portion of a sliding door, said latch mechanism comprising a housing having a slide member with one or more keeper engaging elements to engage a keeper member securable to a sliding door jamb for locking and unlocking said sliding door within a frame, guide means in said housing for guiding said slide member along a straight axis, finger engaging means connected to said slide member and accessible from outside said housing for displacing said slide member along said axis to move said keeper engaging means to a locking or unlocking position, said slide member having an elongated through bore extending co-extensively with said straight axis, said housing being secured to an inner side wall of a door stile of said sliding door, said keeper member being secured to an inner side surface of said door jamb in alignment with said keeper engaging element, said door stile having opposed parallel outer and inner metal side walls, and a load transfer rod extending through said inner and outer metal side walls of said sliding door stile and secured in a back wall of said housing, said load transfer rod being concealed on said outer side wall of said stile, said load transfer rod extending through said bore of said slide member in sliding contact with at least a side edge of said bore in abutment therewith to resist separating lateral forces applied to said slide member by forces entry loads.

2. A latch mechanism as claimed in claim 1 wherein said slide member is an elongated flat metal plate having opposed parallel elongated side edges, said one or more keeper engaging elements being constituted by one or more hook fingers extending from an outer one of said side edges and formed integral with said metal plate, said guide means being guide members disposed in friction contact with said side edges.

3. A latch mechanism as claimed in claim 2 wherein said housing has a side opening for receiving a keeper housing having one or more engageable slots in a front wall for engagement by said one or more hook fingers.

4. A latch mechanism as claimed in claim 2 wherein there are two of said elongated through bore, said through bores being slots, each slot being aligned with a longitudinal axis of said metal plate and positioned in a respective one of opposed end portions thereof, said load transfer rod extending through said bore being a bolt fastener, there being a bolt fastener extending through each said slots.

5. A latch mechanism as claimed in claim 2 wherein said door stile is an extruded hollow style of rectangular cross-section and of material capable of resisting required load.

6. A latch mechanism as claimed in claim 5 wherein said bolt fasteners have a bolt head disposed over said outer side wall of said stile and concealed by an outer handle plate, and at least a threaded free end section of said bolt being threadably engaged in threaded bores located in an inner surface of said lock mechanism housing.

7. A latch mechanism as claimed in claim 1 wherein said finger engaging means is a finger engageable slide member slidingly secured over an outer surface of said lock mechanism housing, a connecting bolt secured to said finger engaging member and said slide member, said connecting bolt extending through a slot in said outer wall of said lock housing and aligned with said straight axis of said slide member.

8. A latch mechanism as claimed in claim 1 wherein said keeper member is a hollow keeper housing having opposed side walls, a connecting rear wall, and a retention front wall, one or more slot openings in said front wall for receiving said one or more keeper engaging elements therein, said side walls being reinforcing walls for said front wall, said front wall defining retaining wall portions adjacent said one or more openings for engagement by hook fingers of said side plate.

9. A latch mechanism as claimed in claim 8 wherein there are two of said keeper engaging elements received in a respective one of two said slot openings in said keeper front wall, and holes in said connecting rear wall for receiving connecting fasteners therethrough from said slot opening or fastener receiving openings in said front wall, said connecting fasteners being concealed inside said hollow keeper housing.

10. A latch mechanism as claimed in claim 9 wherein said keeper housing is formed from stainless steel sheet material, at least one of said holes in said rear wall being a slotted adjustment hole for adjusting the position of said housing.

11. A latch mechanism as claimed in claim 2 wherein said lock mechanism housing is casted from plastics material and has a handle secured thereto, said guide members being formed by opposed guide walls, said hook fingers extending through a keeper receiving opening formed in an outer edge wall.

* * * * *